US005544496A

United States Patent [19]

Stoll et al.

[11] Patent Number: 5,544,496

[45] Date of Patent: Aug. 13, 1996

[54] REFRIGERATION SYSTEM AND PUMP THEREFOR

[75] Inventors: Thomas D. Stoll, Grand Rapids; Lawrence E. Switek, Hopkins, both of Mich.

[73] Assignee: Delaware Capital Formation, Inc., Wilmington, Del.

[21] Appl. No.: 276,054

[22] Filed: Jul. 15, 1994

[51] Int. Cl.[6] ..... F25B 1/00

[52] U.S. Cl. ..... 62/498; 62/DIG. 2; 417/902; 418/268

[58] Field of Search ..... 62/59, 118, 498, 62/DIG. 2; 417/366, 902; 418/268

[56] References Cited

U.S. PATENT DOCUMENTS

| | | | |
|---|---|---|---|
| Re. 30,994 | 7/1982 | Shaw . | |
| 2,091,752 | 8/1937 | Davis . | |
| 2,152,056 | 3/1939 | Kenney et al. . | |
| 2,178,425 | 10/1939 | Johnson . | |
| 3,015,222 | 1/1962 | Wellborn et al. . | |
| 3,399,627 | 9/1968 | Jeep et al. . | |
| 3,639,085 | 2/1972 | Bertsch et al. . | |
| 3,790,311 | 2/1974 | Butts et al. . | |
| 3,865,520 | 2/1975 | Kramer et al. . | |
| 4,021,166 | 5/1977 | Glanvall et al. . | |
| 4,181,474 | 1/1980 | Shaw . | |
| 4,514,157 | 4/1985 | Nakamura et al. . | |
| 4,557,677 | 12/1985 | Hasegawa . | |
| 4,601,644 | 7/1986 | Gannaway . | |
| 4,730,994 | 3/1988 | Maertens . | |
| 4,735,064 | 4/1988 | Fischer . | |
| 4,762,471 | 8/1988 | Assanuma et al. . | |
| 4,768,936 | 9/1988 | Etemad et al. . | |
| 4,838,767 | 6/1989 | Ohe et al. . | |
| 4,898,526 | 2/1990 | Sakamaki et al. . | |
| 4,916,916 | 4/1990 | Fischer . | |
| 4,934,905 | 6/1990 | Richardson, Jr. . | |
| 5,026,263 | 6/1991 | Iwata . | |
| 5,051,076 | 9/1991 | Okoma et al. . | |
| 5,083,909 | 1/1992 | Kunsemiller et al. . | |
| 5,102,317 | 4/1992 | Okoma et al. . | |
| 5,154,593 | 10/1992 | Konishi et al. . | |
| 5,169,299 | 12/1992 | Gannaway . | |
| 5,211,029 | 5/1993 | Uselton et al. . | |
| 5,242,280 | 9/1993 | Fujio . | |
| 5,261,796 | 11/1993 | Niemiec et al. | 417/366 X |
| 5,431,552 | 7/1995 | Schuller et al. | 418/268 X |

OTHER PUBLICATIONS

Liquid Overfeed Systems, Ashrae 1990 Refrigeration Handbook, pp. 2.1–2.9.

Charles C. Hansen III, Design and Application of Semi–Hermetic Refrigerant Pumps, Hansen Technologies Corporation, Bulletin HP–01A, date unknown.

Vane Pumps, Machine Design, Jun. 992, p. 678.

*Primary Examiner*—William E. Tapolcai

*Attorney, Agent, or Firm*—Varnum, Riddering, Schmidt & Howlett LLP

[57] ABSTRACT

A refrigeration system is disclosed in which negative energy storage is provided to significantly reduce electrical energy consumption during peak air conditioning hours. A transfer pump is provided in the system for pumping condensed and mixed phase refrigerant from the negative energy storage to an evaporator coil where it absorbs heat energy from an air conditioned space. The transfer pump is a positive displacement pump employing a rotor and vanes rotating in a pumping chamber. Dual inlets and discharges from the pumping chamber are located to balance forces on the rotor. The inlets enter the pumping chamber radially. A hermetic enclosure seals the pump and an electric drive motor to eliminate dynamic seals within the pump and thereby greatly reduce leakage of refrigeration from the system. A refrigeration overfeed system using a hermetically sealed pump according to the invention is also disclosed.

14 Claims, 6 Drawing Sheets

REFRIGERATION SYSTEM AND PUMP THEREFOR

BACKGROUND OF THE INVENTION

1. Field of the Invention

This invention relates to refrigeration systems in which a pump is used to transfer liquid or mixed phased refrigerant. More specifically, the invention relates to refrigeration systems, and to the pump therefor, in which the pump comprises a positive displacement, sealless, balanced rotor, vane pump.

2. State of the Prior Art

During the summer season electrically driven air conditioning and refrigeration systems place a heavy load on utility power grids during midday hours. This electric capacity is often provided by less efficient, yet low capital cost, power generating equipment. Accordingly, this "peak power" is more expensive to generate per unit of energy. Thus, many utilities charge a premium for electrical power during these peak periods. During the late evening and night when many industrial electrical users are not operating and when air conditioning loads are at their minimum, electrical demand is usually also at a minimum on the utility's power grid. Thus, some electric utilities actually discount power sales during these "off-peak" periods.

The higher "on-peak" price charged for electricity during the highest periods of air conditioning demand increases the overall cost for providing air conditioning in most installations. In response, many designers of air conditioning equipment have endeavored to provide some form of negative energy storage into their air conditioning system whereby the refrigeration equipment can be operated during "off-peak" hours to chill a mass of storage media which can later be used during the "on-peak" periods of the day as a heat sink to draw heat out of an air conditioned space. Typically, such storage media comprises a liquid experiencing some form phase change, such as freezing, to increase its negative energy storage density.

One such an air conditioning system is described in the Uselton et al. U.S. Pat. No. 5,211,029 issued May 18, 1993 and incorporated herein by reference. The Uselton et al. patent discloses a standard freon based compressor driven condensing and evaporating type refrigeration system into which has been incorporated a tank of negative energy storage media. Coils are provided to circulate the refrigerant of the refrigeration system through the tank of negative energy storage media. A transfer pump is provided for drawing condensed and chilled refrigerant from the tank of negative energy storage media and passing it through the evaporator in the refrigeration system.

Another type of air conditioning or refrigeration system is the liquid overfeed system in which excess liquid refrigerant is forced through evaporators to effect cooling. These systems often use pumps to circulate refrigerant. However, the system must be carefully designed and may require more controls to ensure that the pump has adequate subcooled liquid refrigerant available to effect cooling since centrifugal or turbine pumps are often used.

Pumps used in this system must be able to run continuously over a long period of time, be relatively long-lived without breakdowns, must be efficient in operation, and must be able to move mixed phase (gas/liquid) fluids as well as liquid refrigerant. Often, the pump chamber is filled only with vapor phase refrigerant upon start-up so that the pump must be self priming and have a superior dry running capability. Further, such pumps must also be free from leakage of the refrigerant.

Several pumps have been proposed for use in the Uselton et al. refrigeration system. One such pump is a gear pump as the transfer pump. However, most refrigerants typically have very low viscosity and therefore provide insufficient lubrication to prevent rapid wear of moving parts of pumps and compressors. As the gears in a gear pump wear over the life of the pump, the slip of fluid past the rotating gears greatly reduces their efficiency and capacity at a given pressure, especially with such low viscosity pumping liquids.

Centrifugal pumps are often used to pump liquids and have many advantages in this service. However, as the media in the negative energy storage tank warms up, the refrigerant passing through the tank may not be completely condensed and may enter the transfer pump in a mixed phase state. Centrifugal pumps are inappropriate for pumping mixed phase media.

Many types of refrigerants used in evaporative refrigeration systems are potentially harmful to the environment, and newer refrigerants may pose health risks. Also, leakage results in system ineffectiveness. Therefore, it is desirable to minimize all leaks and discharges of refrigerants from the system. Due to its low viscosity, refrigerant is particularly susceptible to leakage past dynamic seals on a pump shaft as it passes through the pump housing.

Due to sliding friction between moving parts, such as rotors, gears, pistons, bearings, etc., pumps and compressors have previously been designed with an oil sump and some means of separation and/or oil return to ensure proper fluid film between parts in relative motion. Typically, a small amount of oil is mixed with the refrigerant to help lubricate moving parts. For some refrigerants, the oil may not be miscible which creates special design problems due to oil fouling of evaporator or condenser tubes, filters, etc. HCFC-22 is particularly miscible with oil, HFC-134*a* is hardly miscible and ammonia is immiscible with oil.

SUMMARY OF THE INVENTION

The refrigeration system according to the invention incorporates a transfer pump for pumping liquid or mixed phased refrigerant to an evaporator. A transfer pump in the system overcomes these and other limitations of the prior art by providing a sealless, vane-type, constant volume pump with balanced rotor.

In a refrigeration system having a condensing unit, an evaporating unit, and a refrigerant for circulation therebetween, a pump is provided to pump liquid and mixed phase refrigerant to the evaporating unit. According to the invention, the pump comprises a positive displacement, sealless, balanced rotor, vane pump. In one preferred embodiment, the refrigeration system incorporates a negative energy storage system. The negative energy storage system has a storage media and refrigerant conduits disposed therein for circulating the refrigerant therethrough alternatively to cool the storage media during a first time period, and to impart heat energy to the storage media during a second time period. A second preferred embodiment comprises an overfeed system having an accumulator and the pump draws from the accumulator.

The pump and a motor are preferably hermetically sealed within a hermetic enclosure. Also preferably, the motor has a shaft supported upon two motor bearings within the hermetic enclosure and the pump has a rotor supported upon two rotor bearings within the hermetic enclosure. The motor shaft preferably couples to the pump rotor with a slip fit.

Preferably, liquid refrigerant from the pump effluent cools the motor, and cools and lubricates the motor bearings. The pump can comprise a pump housing and a motor housing forming the hermetic enclosure. An inlet extends into the pump housing and a discharge passage extends from the pump housing and into the motor housing whereby the liquid refrigerant discharged through the discharge passage cools and lubricates the motor and its bearings. Preferably, the inlet enters the rotor chamber radially and the discharge exits the rotor chamber axially.

The rotor has a series of slots in which vanes are slidably mounted, each slot having a radial outer end and a leading radial wall. The rotor can further be provided with a groove at the outer end of each slot at its leading radial wall to decrease a flow restriction upon the refrigerant leaving the rotor chamber.

The pump housing can have an axial bypass passage which is radially spaced from the rotor chamber. Discharge openings through the end walls of the rotor chamber extend radially from the rotor chamber in alignment with the axial bypass passage through the pump housing.

In one embodiment, the motor is magnetically coupled to the pump. In another embodiment, the motor and pump are mechanically coupled together and are both housed in a hermetically sealed enclosure.

A constant volume, balanced rotor, hermetically sealed vane pump according to the invention comprises an hermetic enclosure comprising a pump housing. The hollow pump housing has a circumferential wall defining a generally elliptical rotor chamber having opposed circular portions, opposed cam portions at some angular displacement from the circular portions and an inlet port connected to each cam portion at a leading edge thereof. The rotor chamber is further defined by an end wall at each axial end of the rotor chamber and has an outlet port connected to each of the cam portions at a trailing edge thereof. A cylindrical pump rotor is rotatably supported within the pump housing for rotation in the rotor chamber. It has a plurality of radially extending, slidably mounted vanes adapted to form a constant volume pumping chamber defined between each pair of adjacent vanes, the rotor, and the circumferential, and end walls at the cam portions between each inlet port and each outlet port.

A motor for the pump preferably comprises a stator mounted within a motor housing, a motor rotor disposed within the stator for rotation and a motor shaft mounted to the motor rotor and extending axially from an axial end of the rotor. The motor housing has bearing supports mounting motor bearings at the ends of the motor rotor that support the motor shaft. A slidable drive coupling between the motor shaft and the pump rotor allows for slight axial and radial movement between the two. A discharge port is provided through the motor housing.

Preferably, the end walls of the pump comprise disk bearings mounted within the pump housing and the pump rotor is supported on the disk bearings. The disk bearings are preferably formed of a self-lubricating material.

The outlet ports through the end wall preferably communicate with the motor housing whereby the fluid to be pumped can cool the motor bearings and one of the bearing supports can have an opening for liquid to pass through. Preferably, the motor bearings are self-lubricating.

The pump rotor can be provided with radial splines extending axially and the motor shaft can be provided with mating radial splines extending axially whereby the splines on the motor shaft and pump rotor slidably couple the motor shaft to the pump rotor. Alternatively, the pump rotor can have an axially extending keyway and the shaft can have a radially extending pin disposed within the keyway whereby the motor shaft slidably couples to the pump rotor.

DETAILED DESCRIPTION

Figure 1:
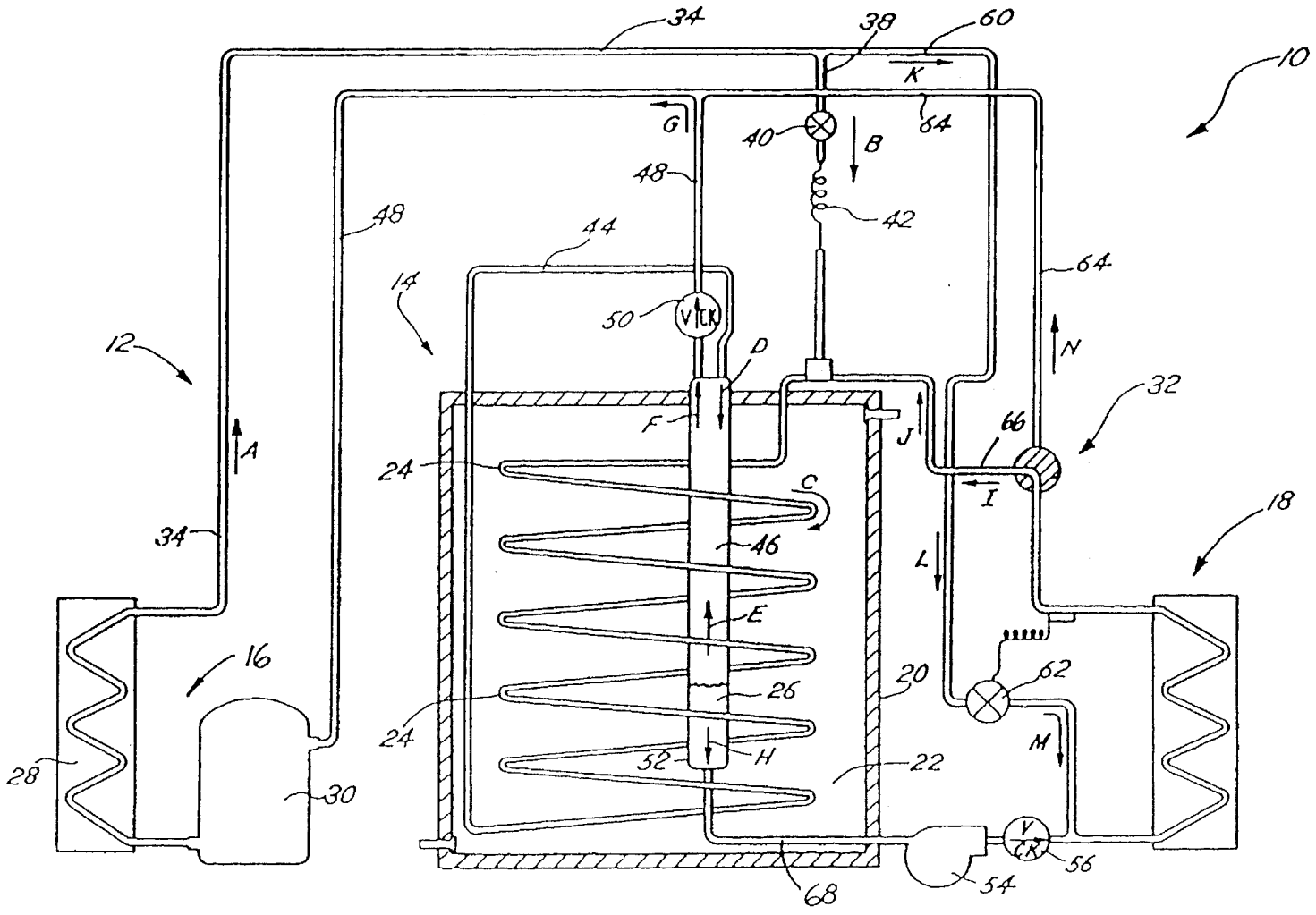
FIG. 1 is a schematic diagram of a multi-modal refrigeration and negative energy storage system which incorporates a pump according to the present invention.

Referring now in the drawings and to FIG. 1 in particular, an air conditioning apparatus and energy storage system 10 is schematically depicted. An air conditioning apparatus generally 12 is provided in connection with a negative energy storage system 14. The air conditioning apparatus 12 includes a condensing unit 16 and a evaporating unit 18. The negative energy storage system 14 principally includes an insulated tank 20 containing a negative heat energy storage media 22 therein and coils 24 disposed within the media 22 for circulating a refrigerant 26 from the air conditioning apparatus 12. The condensing unit 16 includes a condenser 28 and a compressor 30.

The condensing unit 16 and the insulated tank 20 operate during a first time period, which corresponds to "off-peak" utility hours, to cool and preferably to freeze the negative heat energy storage media 22 by circulating cool refrigerant 26 through the coils 24 from the condenser 28 of the condensing unit 16. During a second time period, the negative heat energy stored within tank 20 is communicated with the evaporating unit 18 to provide cooling to an associated closed air conditioning space (not shown), generally corresponding to "on-peak" utility hours. As will be more fully explained hereinafter, this transfer of negative heat energy occurs by circulating the refrigerant 26 through the coils 24 in the tank 20 and on to the evaporating unit 18 during the second time period.

In a third time period, a tank bypass valve 32 is utilized for directly connecting the condensing unit 16 and evaporating unit 18 while avoiding circulation of refrigerant 26 within the coils 24. Thus, during the third time period, heat is not imparted to the cooled or frozen negative heat energy storage media 22 by circulating refrigerant 26 through the negative heat energy storage media 22.

The condenser flow line 34 extends from the condenser 28 and branches into a first branch 38 and a tank bypass 60. The branch line 38 connects the condenser flow line 34 to the coils 24 in the tank 20 and contains an on/off control valve 40. Immediately downstream of the on/off control valve 40 the branch line 38 also contains an expansion device 42 for expanding the refrigerant prior to passing the refrigerant through the coils 24 when it is desired to chill the negative energy storage media 22 within the tank 20. The on/off control valve 40 isolates the tank 20 from the remainder of the air conditioning apparatus 12 during the third time period. A refrigerant return line 44 leads from the coils 24 to an accumulator 46 within the tank 20. Accumulated refrigerant 26 returns to the compressor 30 through a compressor return line 48 which leads from the accumulator 46 to the compressor 30. A check valve 50 in the compressor return line 48 adjacent the accumulator 46 prevents backwards flow into the accumulator.

The tank bypass line 60 extends from the condenser flow line 34 and contains a standard expansion valve 62. From the expansion valve 62, the branch line 60 connects to the evaporator 18. A bypass return line 64 leads from the evaporator into the condenser return line 48, and connects thereto downstream of the check valve 50. The bypass valve 32 is located in the bypass return line 64 and selectively directs flow either into bypass return line 64 (see arrow N) or into an alternate bypass line 66 (see arrows I and J) which leads into the coils 24 in the tank 20. Sump line 68 leads from a bottom 52 of the accumulator 46 through a transfer pump 54 and check valve 56 to the evaporator 18. A preferred embodiment of the pump 54 will be more fully described hereinafter.

The refrigeration system 10 has four modes of operation which will be described with reference to the time periods in which they operate. During the first time period, corresponding to off-peak utility hours when it is desired to chill the negative heat energy storage media 22 in the tank 20, refrigerant vapor 26 is compressed by the compressor 30 and passed through the evaporator 28 where its heat energy is liberated and it condenses into a liquid form. From the condenser 28 the refrigerant passes through the condenser line 34 and into the first bypass line 38 with the on/off valve 40 in the open position. The refrigerant 26 is expanded through the expansion device 42 into a gaseous state to significantly lower its temperature and is then passed into the coils 24 within the tank 20. The refrigerant 26 then passes through the accumulator 46 and into the compressor return line 48 to be recycled.

During the second time period, corresponding to on-peak utility hours when it is desired to provide refrigeration without operating the compressor 30, refrigerant 26 is drawn out of the accumulator 46 through the sump line 68 by the transfer pump 54. It passes into the evaporator 18 where it absorbs energy from the air conditioned space. During this time period, the bypass valve 32 is set to return the refrigerant from the evaporator 18 through the alternate bypass line 66 into the coils 24 within tank 20 and from there into the accumulator 46. During this cycle, the refrigerant 26 is not passed through an expansion valve but merely acts as a heat transfer media from the negative heat energy storage media 22 within tank 20 and the evaporator 18.

During a third time period, corresponding generally to early morning and evening hours which are not considered on-peak hours by the utility, but during which cooling may still be desired, the refrigeration system 12 is operated in a standard fashion and is isolated from the tank 20 and coils 24 by the on/off valve 40. The compressor 30 compresses the refrigerant 26 and passes it through the condenser 28 and from there the refrigerant moves through the condenser line 34 and bypass line 60 to the expansion valve 62 where it is expanded to change phase and lower its temperature. From the expansion valve 62 the refrigerant passes through the condenser 18 and back through the bypass return line 64 and condenser return line 48 to the condenser 30. With the on/off valve 40 in the off position, no refrigerant passes through the coils 24 in tank 20.

If insufficient energy has been stored in the tank 20 during off-peak hours to provide sufficient cooling during the entire on-peak period, it may be desireable to move into a fourth mode of operation in which chilled refrigerant is drawn both from the accumulator 46 and from the expansion valve 62 with the compressor 30 in operation. Thus, the cooling provided by the negative heat energy storage media 22 is supplemented by the normal refrigeration system 12.

Figure 2:
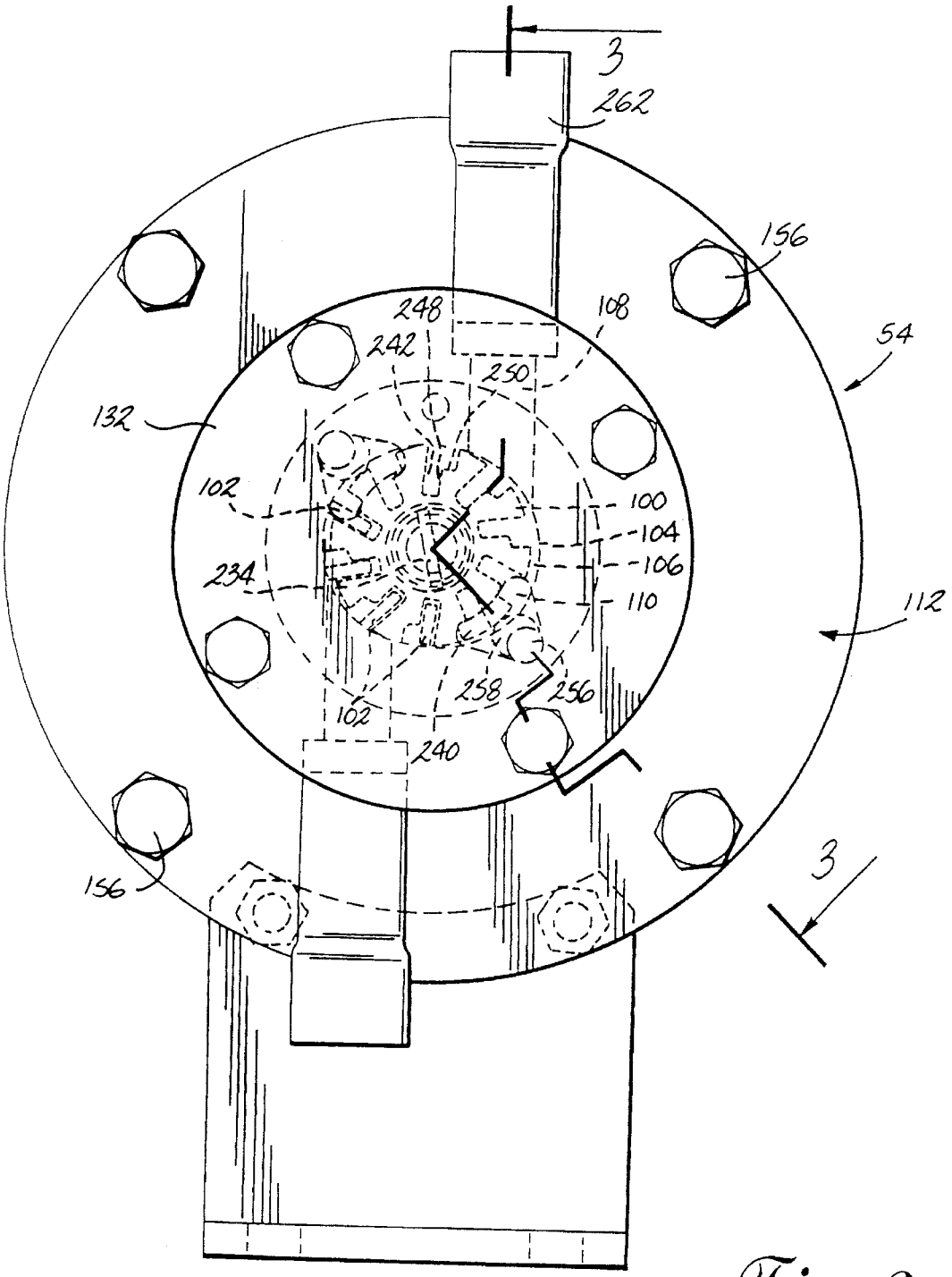
FIG. 2 is a end view of a transfer pump according to the present invention as represented in the schematic diagram of FIG. 1.
Figure 3:
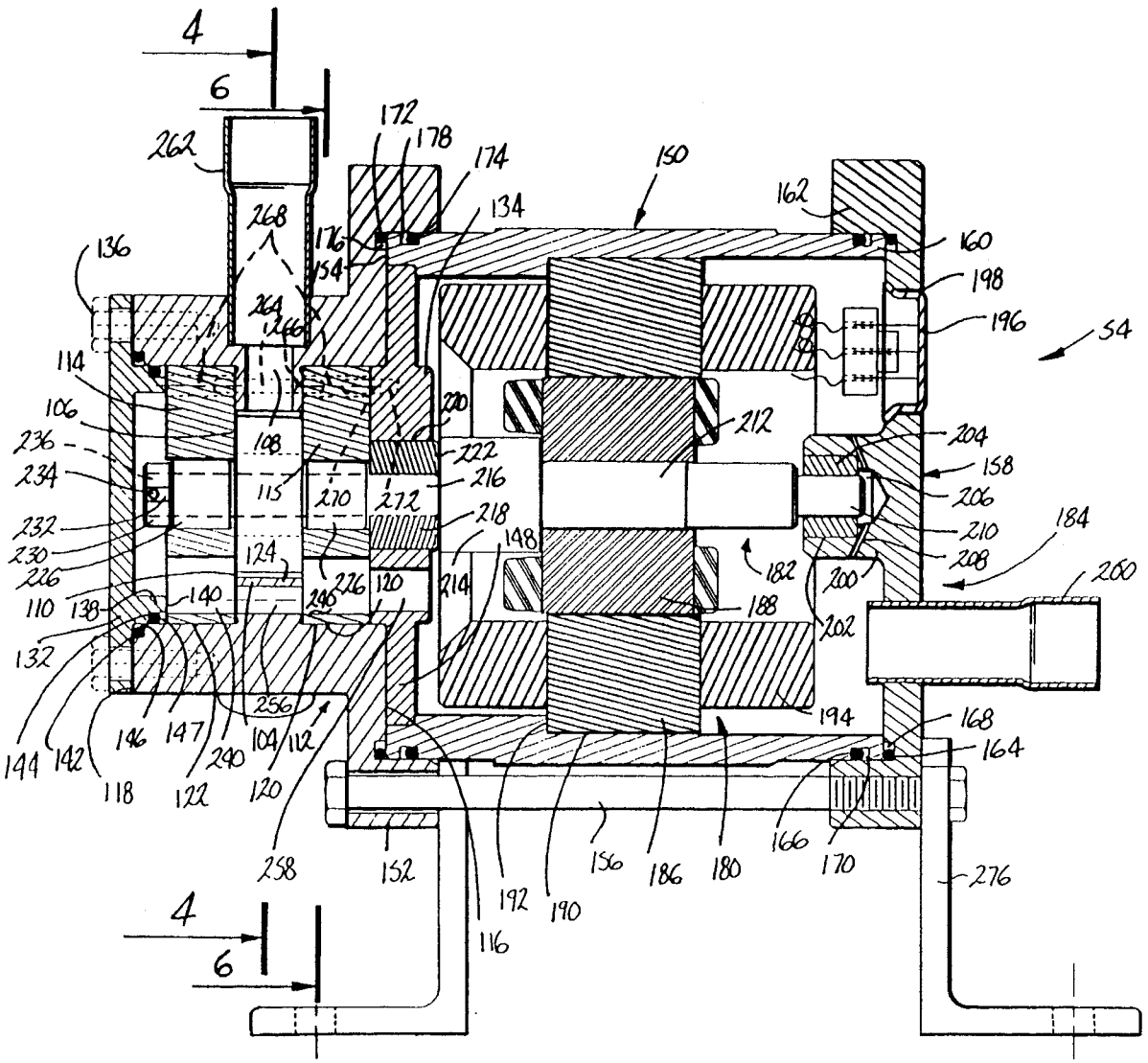
FIG. 3 is a view of the pump shown in FIG. 2 and taken along lines 3—3 of FIG 2.

Turning to FIGS. 2 and 3, pump 54 comprises a pump housing 112, an end cover 132, a pair of end disks 114, 115, and generally a slotted pump rotor 100 carrying a plurality of axial vanes 102. The end disks 114, 115 can be formed of a wear-resistant, self-lubricating material, for example, a plastic and carbon composite material. The end cover 132 is discoidal in shape and mounts to the cylinder out-board side 118 by means of four bolts 136 passing axially through the end cover 132 and into the pump housing 112. The pump rotor 110 is rotatable within in a cam ring 104 forming a pumping chamber 106. Suction is provided through two radial inlet ports 108 which are connected to inlet fittings 262.

The rotor chamber 106 is formed of the cylindrical pump housing 112 and a pair of opposing end disks 114, 115. The pump housing 112 comprises an in-board side 116 and an out-board side 118. An in-board bore 120 extends co-axially into the pump housing 112 from the in-board side 116, and an opposing out-board bore 122 extends coaxially into the pump housing 112 in alignment with the in-board bore 120 from the out-board side 118. The end disk 115 fits snugly within the in-board bore 120, and the other end disk 114 fits snugly within the out-board bore 122. The cam ring 104 is preferably integrally formed with the pump housing 112 between the in-board and out-board bores 120 and 122.

Figure 4:
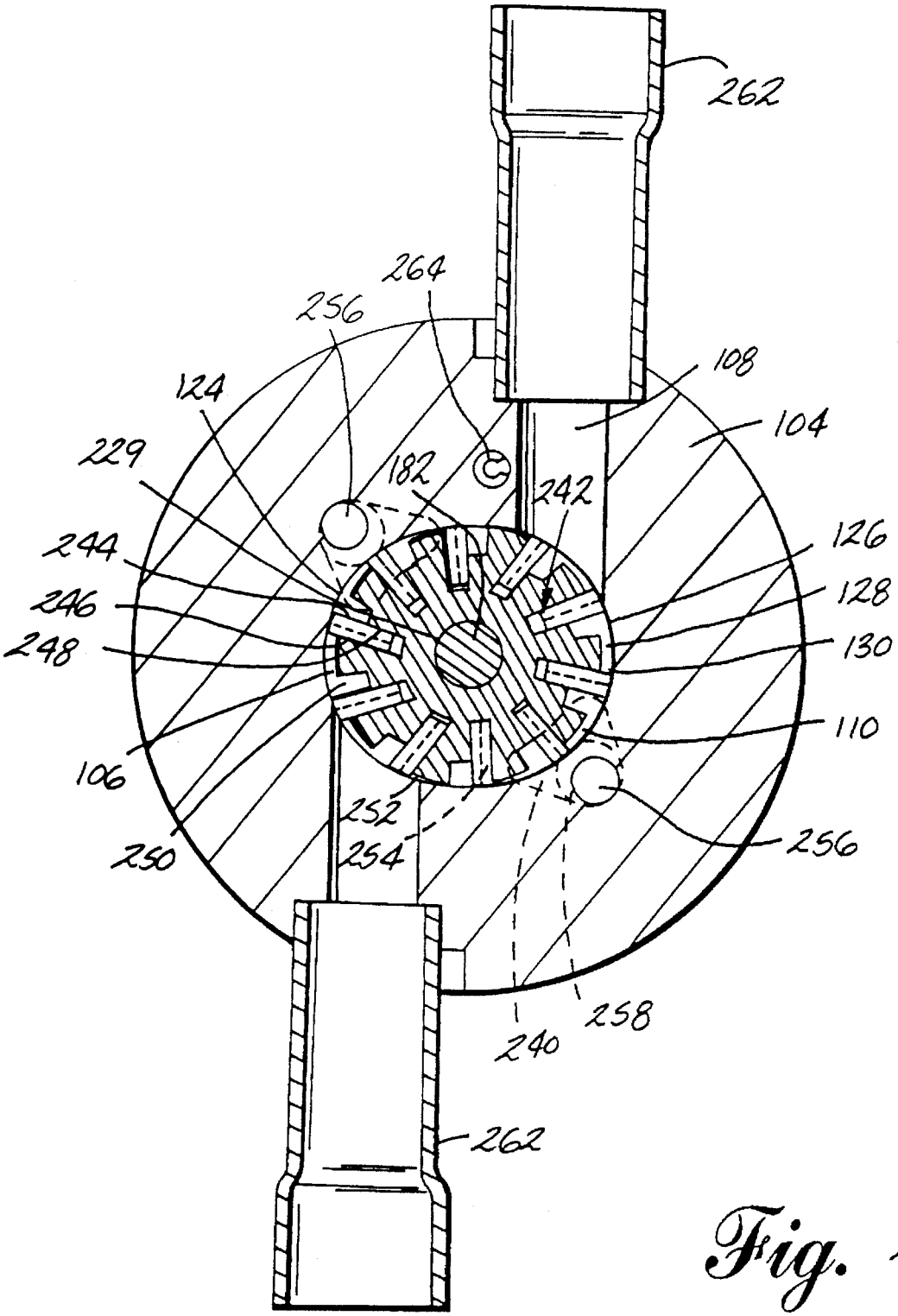
FIG. 4 is a sectional view taken along line 4—4 of FIG. 3.

As best seen in FIG. 4, the rotor chamber 106 comprises a bore 124 through the cam ring 104. The bore 124 is essentially circular and has two "drops" 126 located 180° apart of identical construction to give the bore 124 a slightly elliptical appearance. Each of the drops 126 comprises a slight enlargement of the chamber bore 124 and extends from one of the inlets 108 to one of the discharge portions 110. A central section 128 of each drop 126, defined as being completely between the inlet 108 and discharge 110, has a constant radius so that pumping chambers 130 formed between the drops 126, pump rotor 100 and vanes 102 have a constant volume as the pump rotor 100 rotates within the rotor chamber 106.

Returning to FIG. 3, the end cover 132 at the housing out-board side 118 and a hub 134 at the housing in-board side 116 contain the disks 114, 115 and rotor 100 within the pump housing 112. An inwardly directed annular flange 138 on the end cover 132 is received within and abuts the out-board bore 122. Also, an inside edge 140 of the flange 138 abuts the disk 114. O-rings 142 and 144 are received in grooves 146 and 147 in housing out-board side 118 and end cover annular flange 138, respectively, to hermetically seal the end cover 132 to the pump housing 112.

The hub 134 is also discoidal in shape and fits within the in-board bore 120. An annular flange portion 148 extends outwardly radially on the hub 134 so that the hub 134 is positively located within the pump housing 112 by abutment between the pump housing 112 and the annular flange 148.

The hub 134 also abuts the disk 115 to position and hold it within the pump housing 112.

The hub 134 is held in close abutment with the pump housing 112 by a cylindrical motor housing 150. An inwardly directed annular flange 152 on the pump housing 112 receives an inner end 154 of the motor housing 150. At least four axial bolts 156 pass through the annular flange 152 and are received within an end bell 158 at an outer end 160 of the motor housing 150. Thus, the compression applied by the bolts 156 pulls the motor housing 150 into abutment with the hub annular flange 148 and pump housing 112.

An inwardly directed annular flange 162 on the end bell 158 faces the inwardly directed annular flange 152 on the pump housing 112 and it is the annular flange 162 which receives the bolts 156. Thus, the bolts 156 lie radially outwardly of the motor housing 150. O-rings 164 and 166 are disposed within grooves 168 and 170 in the end bell 158 and motor housing 150. They abut the motor housing outer end 160 and end bell annular flange 162, respectively, and hermetically seal the end bell 158 to the motor housing 150. O-rings 172 and 174 are disposed within grooves 176 and 178 in the pump housing 112 and motor housing 150 to hermetically seal the pump housing 112 to the motor housing 150. A motor 180 is disposed within the motor housing 150. A motor shaft 182 extends from the motor 180 through the pump rotor 100. Thus, all of the pump components are disposed within a hermetically sealed enclosure 184 comprised of the end bell 158, motor housing 150, pump housing 112 and end cover 132. This obviates the need for dynamic seals between the pump housing 112 and motor 180 which are an inherent source of leakage in prior applications.

The pump 54 is thus a "sealless" pump as it contains no dynamic shaft seals on the pump rotor 100. Sealless pumps may fall into one of three categories: canned pumps, magnetically coupled pumps and hermetic pumps. In a canned pump, at least the pump and motor rotor are contained within a hermetically sealed housing. The magnetic fields from the stator must pass through a can enclosing the motor rotor. In a magnetically coupled pump, a hermetically sealed enclosure contains the pump and a driven magnet. A drive magnet affixed to an electric motor magnetically couples with the driven magnet to operate the pump. In a hermetic pump, the motor and pump are sealed within a hermetic enclosure. Further, the motor stator is not separated from the pumped fluid by a can, but rather it is bathed within the fluid. The pump 54 is of the hermetic configuration. It will be understood by those skilled in the art that the principles of the invention are not limited to sealless pumps which are hermetic as disclosed, but also include pumps of the magnetically coupled and canned varieties.

The motor 180 has a stator 186 and rotor 188 of a type commonly known in the art. The stator 186 is secured to an inner surface 190 of the motor housing 150, as by an interference fit or other mechanical fastening means. An annular shoulder 192 within the motor housing 150 positively locates of the stator 186 within the motor housing 150 and eases assembly. The stator 186 is provided with windings 194 and is wired to a point exterior of the hermetic enclosure 184 by an electrical connector 196 received within an aperture 198 in the end bell 158. The electrical connector 196 may be of any of the types well-known in the art for such service which maintains the hermetic seal of the hermetic enclosure 184.

A cylindrical hub 200, integrally formed with the end bell 158, extends towards the motor 180. It has a first bore 202 receiving a cylindrical carbon bushing bearing 204 and a first end 210 of the motor shaft 182 rotates within the bushing bearing 204. A second, smaller diameter, bore 206 extends coaxially into the cylindrical hub 200 from the first bore 202 and intersects two sloping bores 208 passing radially at an approximately 60° angle into the hub 200.

Figure 5:
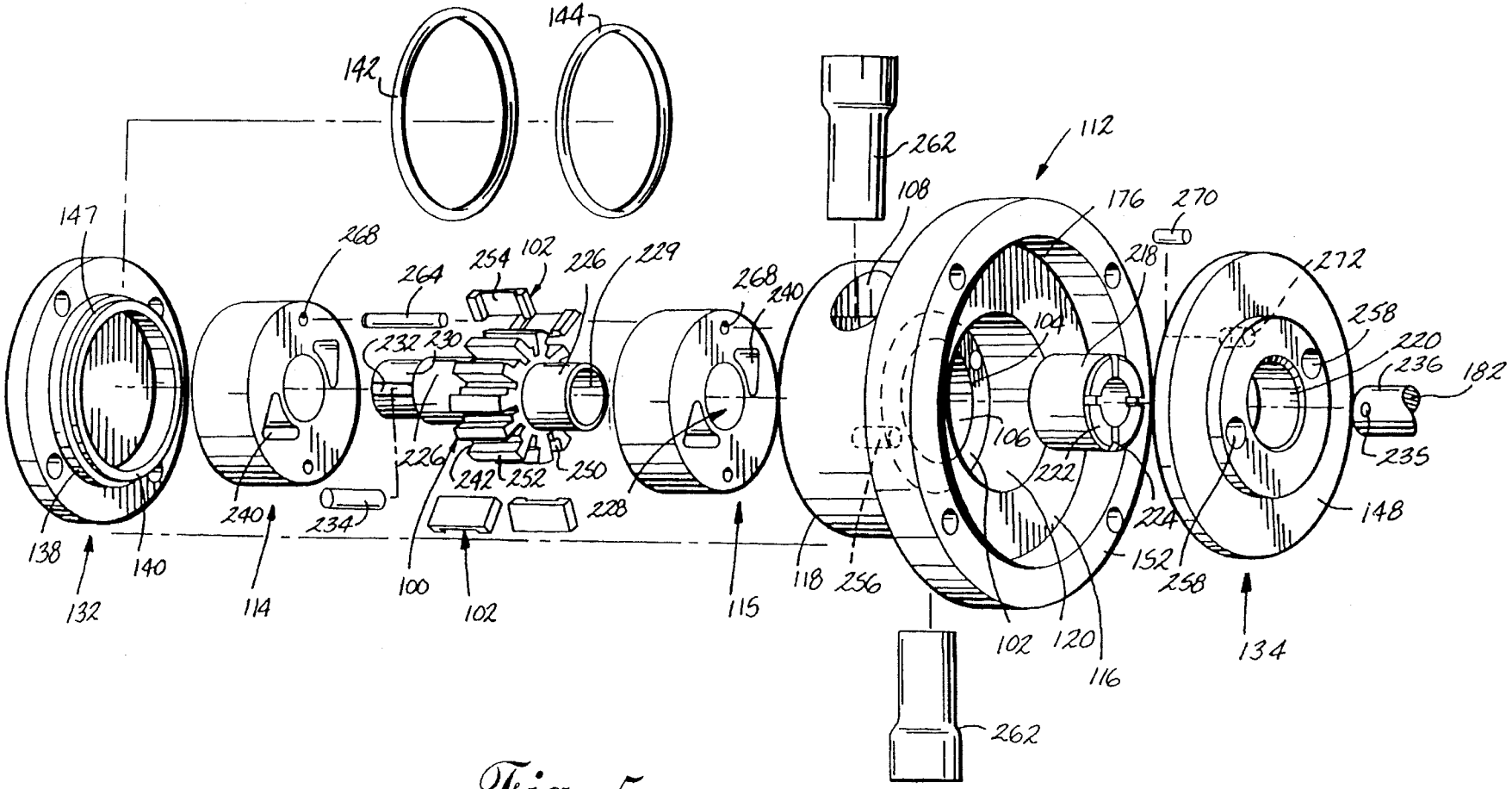
FIG. 5 is an exploded view of a pumping chamber of the pump of FIG. 2.
Figure 6:
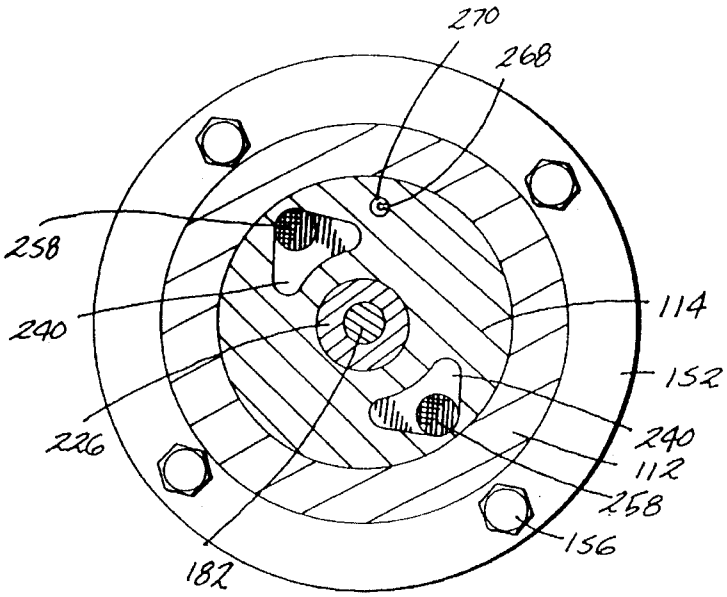
FIG. 6 is a sectional view taken along line 6—6 of FIG. 3.

A central portion 212 of the motor shaft 182 is coaxially received within the motor rotor 188 and attaches thereto, as by press fitting. Adjacent the central portion 212, an annular flange 214 of a larger diameter than the central portion 212 extends outwardly radially from the motor shaft 182. A bearing-receiving portion 216 of the motor shaft 182, adjacent the annular flange 214, is machined to a fine tolerance and rotates within a carbon bushing bearing 218 supported within a coaxial bore 220 in the hub 134. Preferably, an outside edge of the hub bore 220, adjacent the motor 180, is slightly chamfered. The motor shaft annular flange 214 abuts one end 222 of the bushing bearing 218 and, as best seen in FIG. 5, the bushing bearing end 222 has four shallow radial grooves 224 spaced 90° apart from one another. The bearings 204 and 218 can be formed of Vespel™ material.

The pump rotor 100 has extending axially from either side thereof shaft portions 226 which are sized to rotate freely within central bores 228 in the disks 114 and 115. A rotor central bore 229 (FIG. 5) passes coaxially through the pump rotor 100, including the shaft portions 226, and coaxially receives the motor shaft 182. An outboard end of the pump rotor 230 has a key-way 232 for receiving a drive pin 234 which extends radially from an aperture 235 through a second end 236 of the motor shaft 182. The drive pin 234 thus provides positive engagement between rotation of the motor shaft 182 and the pump rotor 100. Alternatively, mating axial splines (not shown) can be provided on the rotor 100 internal of the rotor bore 229 and on the motor shaft second end 236 to slidably couple the two parts.

Turning to FIG. 4, fluid to be pumped, such as the refrigerant 26 (see FIG. 1) enters the rotor chamber 106 through the two radial inlets 108. As the rotor 100 rotates, centrifugal force moves the vanes 102 outwardly to form a volume into which the fluid is pushed by inlet pressure. As the pump 54 is designed to pump incompressible fluids, the pumping chambers 130 have a constant volume to avoid compression of the pumped fluid 239 as it passes through the pumping chambers 130. At the end of its travel through the pumping chambers 130, the fluid moves out of the rotor chamber 106 and into two triangular-shaped apertures 240 in the disks 114, 115 on either side of the rotor chamber 106.

Turning also to FIG. 5, the vanes 102 operate in generally radial slots 242 in the pump rotor 100. The vane slots 242 are slightly canted in the direction of rotation to decrease stresses on the vanes 102 and thereby increase their wear life. Each of the vanes 102 has a high pressure side 244 and a low pressure side 246 and the vane high pressure side abuts a leading radial wall 248 in the vane slot 242. A slight axial groove 250 intersects an outer circumferential face of the rotor 252 at the leading radial wall 248 and provides an enlarged passageway for the pumped fluid to escape the pumping chambers 130 as the vanes reach the apertures 240. Without this provision, when used to pump a relatively small volume of fluid, the pumping chambers 130 must necessarily be very small at the intersection with the triangular disk apertures 240 and would otherwise thus create a flow restriction and decrease the overall efficiency of the pump 54.

Each vane 102 has a slight C-shape formed by a radially oriented rectangular groove 254 along its high pressure side 244 and facing the rotor axial grooves 250. The groove 254 channels pumped fluid around the vane 102 to seat it against the cam ring 104 and provides a passage for fluid to escape as the vane moves inwardly of the slot 242.

After the pumped fluid enters the triangular disk apertures 240 it flows axially through outlet bores 256 and 258 in the cam ring 104 and hub 134, respectively, which are aligned with the triangular apertures 240. The pumped fluid 238 passes through the motor housing 150 and exits the hermetic enclosure 184 through a discharge fitting 260 in the end bell 158. Similar fittings 262 are preferably provided in the pump housing 112 in communication with the radial inlets 108.

The pumped fluid 238 bathes the entire interior of the hermetic enclosure 184 to cool bearing surfaces and the motor 180. In particular, the pump fluid 238 cools the bushing bearings 204 and 218. During start-up of the pump 54, the hermetic enclosure 184 may not be completely filled with pumped fluid 238. Thus, the bushing bearings 204 and 218 should preferably be formed of a self-lubricating material such as carbon. Also, the end disks 114, 115 should also be formed of a similar self-lubricating material. The pump 54 must have a long service life. It is therefore imperative that the bushing bearings 204 and 218 remain viable throughout the life of the pump 54.

The pumping chambers 130 are aligned 180° apart across the rotor 100 whereby forces imparted upon the pumping rotor 100 are radially balanced. A high pressure force created on one side of the pump rotor 100 is balanced by a similar and equal high pressure force on an opposite side of the pump rotor (180 degrees across the rotor) to create a resultant zero force magnitude. Vibration of the pump rotor 100 and shaft 182 are kept to a minimum to preserve the integrity of the bushing bearings 204 and 218. It is understood of course, that self-lubricating bushing bearings of the type illustrated as 204 and 218 are susceptible to wear in an unprotected environment. The design of the pump 54 balances forces on the shaft 182 to preserve the integrity of the bearings 204 and 218 over the expected service life of the pump 54.

The pump is also preferably mounted in a vertical orientation with the motor 180 on top. This is to minimize radial loads on all bearings due to the weight of rotating parts, as well as to force any vapors, which might form from the vaporization of cold refrigerant as it absorbs heat in the motor, out the discharge 260 and into the system.

For ease in assembly and to more accurately align the disks 114 and 115 and hub 148 with the cam ring 104 for greatest pumping efficiency, an alignment pin 264 is disposed within aligned bores 266 and 268 in the cam ring 104 and disks 114 and 115 respectively, thereby positively and accurately locating the triangular-shaped disk apertures 240 with respect to the cam ring 104. Also, an additional alignment pin 270 is received within aligned bores 272 and 268 in the hub 134 and one of the disks 114, respectively to thereby align the hub outlet bores 258 with the triangular apertures 240 through the disk 114.

The materials of the pump components provide a long operating life and economical construction. Preferably, the vanes 102 are formed of a wear-resistant, self-lubricating material such as a self-lubricating composite of carbon and plastic. The disks 114, 115 and bushing bearings 204 and 218 are also preferably formed of a wear-resistant, self-lubricating material such as a carbon-plastic composite material. The pump rotor 100 and motor shaft 182 are preferably formed of steel or other suitable material, especially as may be formed by powder metallurgy techniques. The hub 134, pump housing 112 and end cover 132 are formed of cast iron, and the motor housing 150 and end bell 158 are formed of steel. Cast iron, stamped metal or other legs 276 can be provided to support the pump 54.

When the refrigeration system 10 is operated in either the second or fourth time periods, the pump 54 is called upon to transfer liquid or mixed phase refrigerant 26 from the accumulator into the evaporator 18. The radially oriented inlets 108 reduce the net positive suction head (NPSH) required by the pump by providing little resistance to the flow of refrigerant 26 entering the rotor chamber 106. As the refrigerant 26 enters the rotor chamber 106 through one of the inlets 108, the vanes 102 seal a volume of the refrigerant 26 into one of the constantly forming pumping chambers 130. As previously described, the pumping chambers 130 form between adjacent vanes 102, the rotor outer face 252 and the cam ring 104 within the drop central sections 128. The vanes 102 move the refrigerant 26 through the pumping chamber 130 without compression as the drop central sections 128 are shaped to provide constant volume pumping chambers 130. The pumped refrigerant 26, or other pumped fluid, moves axially out of the pumping chamber 130 and into the triangular apertures 240 in the end disks 114 and 115. Flow into the aperture 240 in the outboard disk 114 travels through the cam ring outlet bore 256 into the aperture 240 in the inboard disk 115. From the aperture 240 in the inboard disk, the pumped refrigerant 26 passes into the motor housing 150 through the hub outlet bore 258 and out of the pump 54 through the discharge fitting 260 in the end bell 158.

As the flow of refrigerant passes through the motor housing 150 it cools the motor 180 and bearings 204 and 218. Refrigerant also travels to other areas within the hermetic enclosure 184 to lubricate and cool all of the moving parts. For instance, low pressure areas forming in the rotor chamber 106 as the rotor 100 rotates tend to draw some of the low viscosity refrigerant 26 back into the rotor chamber 100 between the rotor shaft portions 226 and the end disks 114 and 115.

Flow enters duplicate pumping chamber 130 formed 180° across the rotor chamber 106 by the orientation of the drops 126. The symmetrical arrangement of the pumping chambers 130 balances radial forces acting on the rotor 100 to greatly reduce vibration and stresses on the various pump components. Combining balanced operation and self-lubricating bearings provides for long bearing life with high efficiency.

Figure 7:
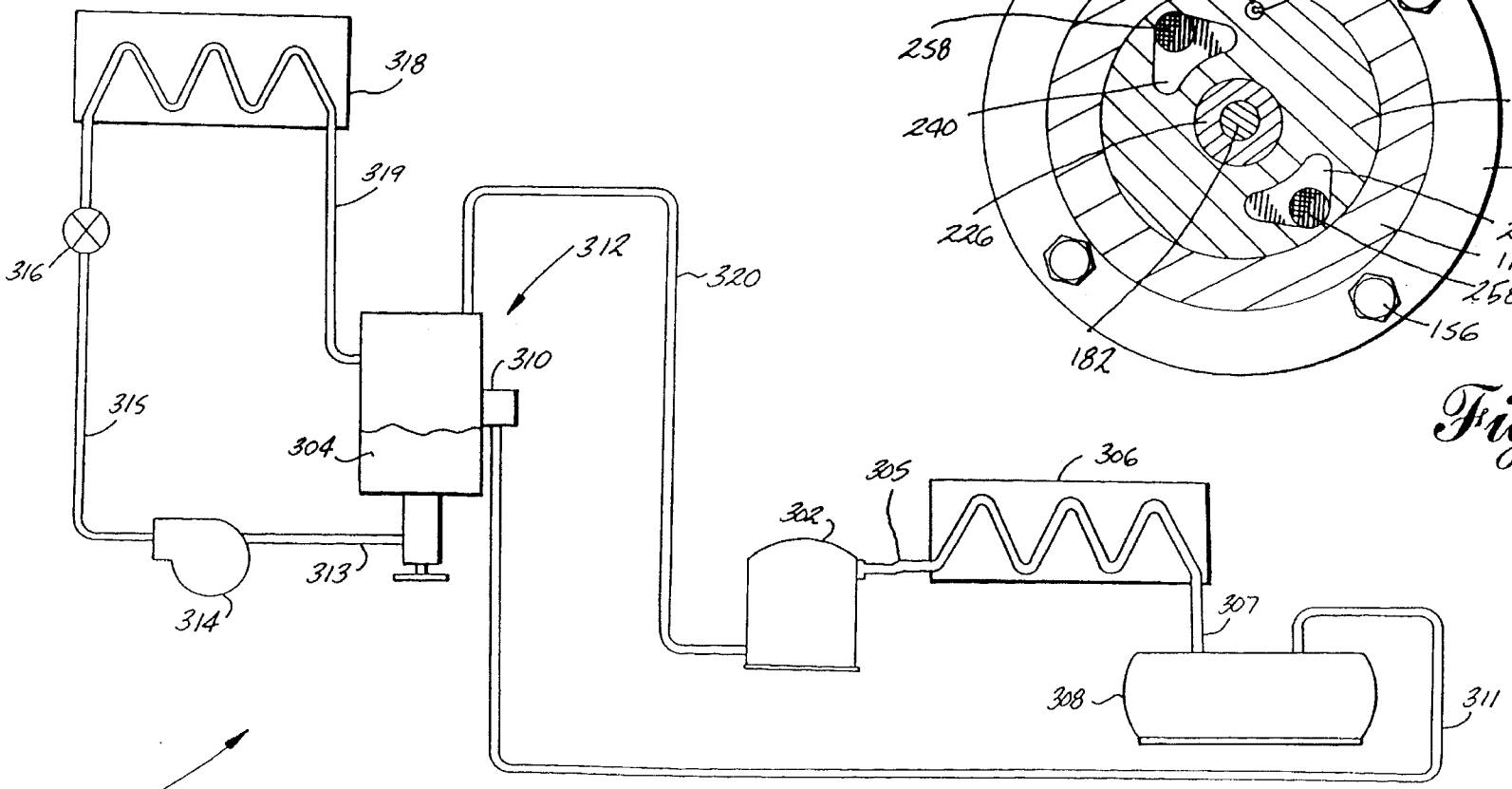
FIG. 7 is a schematic diagram of an overfeed refrigeration system which incorporates a pump according to the present invention.

An additional service for which pumps according to the invention are ideally suited is in a liquid overfeed refrigeration system such as is illustrated at 300 on FIG. 7. The liquid overfeed system 300 comprises a compressor 302 which compresses a refrigerant and passes the compressed refrigerant through a compressor outlet line 305 to a condenser 306. From the condenser 306, the refrigerant 304 passes through a condenser outlet line 307 to a receiving tank 308. A low level sensor switch 310 controls the inflow of refrigerant from the receiving tank 308 into an accumulator 312 through a liquid infeed line 311. Liquid refrigerant 304 is drawn from the bottom of the accumulator 312 through a sump line 313 by a pump 314 according to the present invention. The pump 314 drives the refrigerant 304 through a pump outlet line 315 and through an expansion valve 316 in the pump outlet line 315 into an evaporator 318. Refrigerant from the evaporator 318 is either entirely or mostly in the vapor phase and enters the top of the accumulator 312 through a vapor infeed line 319. A compressor suction line 320 connects the top of the accumulator 312, which contains refrigerant 304 in the vapor phase, to an inlet of the compressor 302.

In this configuration of refrigeration system, the phase of the refrigerant 304 leaving the evaporator 318 does not need to be tightly controlled as the accumulator 312 acts as a phase separator so that only vapor phase refrigerant 304 enters the compressor 302. Negative energy storage can be incorporated into such a system by placing coils (not shown) and the accumulator 312 into a negative energy storage media (not shown) similar to the system illustrated in FIG. 1.

The pump 314 is identical to the pump 54 illustrated and described in detail with reference to FIGS. 2 through 6. If vapor phase refrigerant is drawn into the pump 314, it will not affect the performance of the pump 314 or the system 300. Also, since the pump 314 pumps a constant volume, the flow provided by the pump 314 will not vary despite variations in installation piping which create varying pressure drops in the system.

While the invention has been particularly described in connection with specific embodiments thereof, it is to be understood that this is by way of illustration and not of limitation, and that the scope of the appended claim should be construed as broadly as the prior art will permit. For instance, it will be understood by one of ordinary skill in the art that the pump motor can be magnetically coupled to the pump while maintaining a sealed pump and many of the other advantages of the present invention. Also, it will be understood that the principles of the invention can be applied to a canned pump. While the hermetic configuration disclosed employs a serviceable construction employing O-rings, the hermetic enclosure 184 can be sealed by means of welding or brazing. If desired, the pump 54 can be configured so that flow enters and exits the rotor chamber 106 either axially or radially. While the pump 54 is particularly well suited for the disclosed services in the combined multi-modal air conditioning with negative energy storage and liquid overfeed refrigeration systems, it provides similar advantages in other services such as the transfer of liquified gases or hazardous substances.

What is claimed is:

1. In a refrigeration system having a condensing unit, an evaporating unit, a refrigerant for circulation between the condensing unit and the evaporating unit, and a pump to pump liquid refrigerant from the condensing unit to the evaporating unit, the improvement comprising:

the pump comprising a hermetically sealed enclosure with an inlet opening and an outlet opening, a pump rotor mounted for rotation within the hermetically sealed enclosure on bearings wholly within the hermetically sealed housing, the pump rotor having a plurality of radially disposed vanes which form with the rotor and the enclosure a balanced rotor, positive displacement vane pump;

the enclosure has a housing forming a generally elliptical rotor chamber, the rotor is mounted for rotation therein, a discharge passage extends axially from the rotor chamber;

the rotor has a series of slots in which the vanes are slidably mounted, each slot having a radial outer end and a leading radial wall;

the rotor further has a groove at the outer end of each slot at its leading radial wall to decrease a flow restriction upon the refrigerant leaving the rotor chamber; and the hermetically sealed enclosure housing further forms a motor chamber, and a discharge passage extends from the rotor chamber into the motor chamber.

2. A refrigeration system according to claim 1 wherein the refrigeration system further comprises a negative energy storage system, the negative energy storage system comprising a storage media and refrigerant conduits disposed therein for circulating the refrigerant therethrough alternatively to cool the storage media during a first time period, and to impart heat energy to the storage media during a second time period.

3. A refrigeration system according to claim 1 and further comprising an accumulator for receiving refrigerant from the evaporator, the compressor being connected to the accumulator for receiving vapor phase refrigerant and the pump being connected to the accumulator for receiving liquid and mixed phase refrigerant.

4. A refrigeration system according to claim 1 wherein the rotor is mounted for rotation within a generally elliptical rotor chamber, the inlet opening extends into the rotor chamber, and the inlet opening enters the rotor chamber radially.

5. A refrigeration system according to claim 4 wherein the pump further comprises a discharge passage from the rotor chamber and the discharge passage exits the rotor chamber axially.

6. A refrigeration system according to claim 1 and further comprising an axial bypass passage through the pump housing which bypass passage is radially spaced from the rotor chamber, the rotor chamber is further defined by axial end walls, the discharge passage comprises discharge openings through the end walls, and the discharge openings extend radially from the rotor chamber to align with the axial bypass passage through the pump housing.

7. In a refrigeration system having a condensing unit, an evaporating unit, a refrigerant for circulation between the condensing unit and the evaporating unit, and a pump to pump liquid refrigerant from the condensing unit to the evaporating unit, the improvement comprising:

the pump comprising a hermetically sealed enclosure with an inlet opening and an outlet opening, a pump rotor mounted for rotation within the hermetically sealed enclosure on bearings wholly within the hermetically sealed housing, the pump rotor having a plurality of radially disposed vanes which form with the rotor and the enclosure a balanced rotor, positive displacement vane pump; and the hermetically sealed enclosure comprises a housing forming a rotor chamber, the pump rotor is mounted for rotation in the rotor chamber and the pump inlet is connected directly to the rotor chamber.

8. A refrigeration system according to claim 7, wherein the pump further comprises a motor and the rotor and motor are both hermetically sealed within the hermetically sealed housing.

9. A refrigeration system according to claim 4 wherein the motor further comprises a shaft supported upon two motor bearings within the hermetic enclosure, the pump rotor is supported upon two rotor bearings within the hermetic enclosure, and the motor shaft is coupled to the pump rotor with a slip fit.

10. A refrigeration system according to claim 9 wherein liquid refrigerant from the pump effluent cools the motor and pump rotor bearings.

11. A refrigeration system according to claim 10 wherein liquid refrigerant from the pump effluent lubricates the motor and pump rotor bearings.

12. A refrigeration system according to claim 11 wherein the hermetic enclosure comprises a pump housing and a motor housing, the rotor is disposed within the pump housing, the inlet opening extends into the pump housing and a discharge passage extends from the pump housing and into the motor housing whereby the liquid refrigerant discharged through the discharge passage cools the motor bearings.

13. A refrigeration system according to claim 7 wherein the pump further comprises a motor and the motor is magnetically coupled to the pump.

14. A system for pumping liquified gases having a pump comprising a hermetically sealed enclosure with an inlet opening and an outlet opening, a pump rotor mounted for rotation within the hermetically sealed enclosure on bearings wholly within the hermetically sealed enclosure, the pump rotor having a plurality of radially disposed vanes which form with the rotor and the enclosure a balanced rotor, positive displacement vane pump;

the hermetically sealed enclosure comprises a housing forming a rotor chamber, the pump rotor is mounted for rotation in the rotor chamber and the pump inlet is connected directly to the rotor chamber;

the hermetically sealed enclosure housing further forms a motor chamber, and a discharge passage extends from the rotor chamber into the motor chamber; and the pump further comprises a motor which is mounted within the hermetically sealed enclosure in the motor chamber; and the hermetically sealed enclosure outlet opening is connected directly to the motor chamber.

* * * * *

UNITED STATES PATENT AND TRADEMARK OFFICE

CERTIFICATE OF CORRECTION

PATENT NO. : 5,544,496

DATED : August 13, 1996

INVENTOR(S) : Stoll et al.

It is certified that error appears in the above-indentified patent and that said Letters Patent is hereby corrected as shown below:

Claim 9, column 12, line 51, "4" should read --8--.

Signed and Sealed this

Nineteenth Day of November, 1996

*Attest:*

Bruce Lehman

BRUCE LEHMAN

*Attesting Officer*

*Commissioner of Patents and Trademarks*